US010274223B2

(12) United States Patent
Hong et al.

(10) Patent No.: US 10,274,223 B2
(45) Date of Patent: Apr. 30, 2019

(54) WATER-RECEIVING TRAY STRUCTURE FOR INDOOR UNIT OF AIR CONDITIONER, INDOOR UNIT AND AIR CONDITIONER

(71) Applicants: GD MIDEA HEATING & VENTILATING EQUIPMENT CO., LTD., Foshan (CN); MIDEA GROUP CO., LTD., Foshan (CN)

(72) Inventors: Zhirong Hong, Foshan (CN); Ming Song, Foshan (CN); Yiyang Mo, Foshan (CN); Yuzhao Zhang, Foshan (CN)

(73) Assignees: GD MIDEA HEATING & VENTILATING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 15/818,775

(22) Filed: Nov. 21, 2017

(65) Prior Publication Data

US 2018/0149385 A1 May 31, 2018

(30) Foreign Application Priority Data

Nov. 25, 2016 (CN) ..... 2016 2 1295396 U

(51) Int. Cl.
*F24F 13/22* (2006.01)

(52) U.S. Cl.
CPC ..... *F24F 13/224* (2013.01)

(58) Field of Classification Search
CPC ..... F24F 13/224; F24F 13/22; F24F 13/222; F28F 17/005
See application file for complete search history.

(56) References Cited

U.S. PATENT DOCUMENTS 4,410,033 A * 10/1983 Wawro ..... F24F 1/0007 165/137
5,511,386 A * 4/1996 Russ ..... F24F 1/0007 62/285
5,715,697 A * 2/1998 Rust, Jr. ..... F24F 1/0007 62/286

* cited by examiner

*Primary Examiner* — Elizabeth J Martin
(74) *Attorney, Agent, or Firm* — Kilpatrick Townsend & Stockton, LLP

(57) ABSTRACT

A water receiving in an air conditioner is disclosed. Further, a water-receiving tray structure for an indoor unit of an air conditioner, an indoor unit and an air conditioner. The water-receiving tray structure includes a water-receiving tray, an elevating member and a fixed member; the indoor unit having a casing with a first end defining a return-air inlet and a second end opposite to the first end and defining the air outlet, the water-receiving tray being arranged in a direction from the return-air inlet to the air outlet and being located below a heat exchanger of the indoor unit; the elevating member being arranged at an air outlet end of the indoor unit and supporting an air outlet side of the water-receiving tray; the fixed member being arranged in the indoor unit and being connected to an air outlet side of the indoor unit.

3 Claims, 2 Drawing Sheets

WATER-RECEIVING TRAY STRUCTURE FOR INDOOR UNIT OF AIR CONDITIONER, INDOOR UNIT AND AIR CONDITIONER

CROSS-REFERENCE TO RELATED APPLICATION

This application claims priority to and benefits of Chinese Patent Application Serial No. 201621295396.8, filed with the State Intellectual Property Office of P. R. China on Nov. 25, 2016, the entire content of which is incorporated herein by reference.

FIELD

The present disclosure relates to a technical field of water receiving in an air conditioner, and more particularly to a water-receiving tray structure for an indoor unit of an air conditioner, an indoor unit and an air conditioner.

BACKGROUND

Currently, there are two water-receiving trays disposed in an indoor unit of many air conditioners in North America, to adapt to a longitudinal arrangement and a transverse arrangement. As shown in FIG. 1, a heat exchanger 3 inside an indoor unit 1 generally is in the shape of A. A cusp of the heat exchanger is upwards in the case of the longitudinal arrangement and the cusp of the heat exchanger is leftwards or rightwards in the case of the transverse arrangement. In the transverse arrangement, the indoor unit defines a return-air inlet at a left side, and in some cases air may be blown to an air outlet 55 from left to right or blown from right to left. However, a water-receiving tray 2 at a lateral side is located below the heat exchanger, causing that a blowing direction is basically parallel to an arrangement direction of the water-receiving tray, in which case water in the water-receiving tray in a horizontal direction cannot be drained smoothly, and when a lot of water stores in the water-receiving tray, the wind may often blow the water in the water-receiving tray to move.

SUMMARY

(1) Technical Issue to be Solved

An objective of the present disclosure is to provide a water-receiving tray structure for an indoor unit of an air conditioner, an indoor unit and an air conditioner, so as to solve the problem that wind may blow water, when a lot of water stores in the water-receiving tray.

(2) Technical Scheme

For solving the above technical problem, a water-receiving tray structure for an indoor unit of an air conditioner is provided by the present disclosure, which includes a water-receiving tray, an elevating member and a fixed member;

the indoor unit having a casing with a first end defining a return-air inlet and a second end opposite to the first end and defining an air outlet, the water-receiving tray being arranged in a direction from the return-air inlet to the air outlet and being located below a heat exchanger of the indoor unit;

the elevating member being arranged at an air outlet end of the indoor unit and supporting an air outlet side of the water-receiving tray; and the fixed member being arranged in the indoor unit and being connected to an air outlet side of the indoor unit.

In some embodiments, the elevating member includes a threaded hole and a bolt;

the threaded hole is arranged at an air outlet end of the casing of the indoor unit and is located below the air outlet side of the water-receiving tray; and the bolt passing through the threaded hole extends to a bottom of the air outlet side of the water-receiving tray.

In some embodiments, the fixed member includes a spring, a first end of the spring is connected to the air outlet side of the water-receiving tray and a second end of the spring is connected to an inner wall of the casing of the indoor unit.

In some embodiments, the spring is configured as a tension spring, the first end of the spring is higher than the second end of the spring.

In some embodiments, the spring is configured as a pressure spring, the first end of the spring is lower than the second end of the spring.

In some embodiments, the fixed member further includes a buckle plate, the buckle plate is in the shape of an inverted L, an upper portion of the buckle plate is fixedly hooked to the air outlet side of the water-receiving tray and a lower end of the buckle plate is fixedly connected to the first end of the spring.

In some embodiments, a fixed edge plate is arranged to an inner side wall of the indoor unit, a side wall of the fixed edge plate defines a guide-track groove, and a lower portion of the buckle plate is placed in the guide-track groove.

In some embodiments, the second end of the spring is fixed to the fixed edge plate.

An indoor unit of an air conditioner is further provided by the present disclosure, and is provided with a heat exchanger and the water-receiving tray structure therein, in which, the casing of the indoor unit has a first end defining a return-air inlet and a second end opposite to the first end and defining an air outlet, the water-receiving tray of the water-receiving tray structure is arranged in a direction from the return-air inlet to the air outlet and is located below the heat exchanger.

An air conditioner is provided by the present disclosure and includes the indoor unit of the air conditioner.

(3) Technical Effect

For the technical scheme provided by the present disclosure, the elevating member is arranged to the air outlet end of the indoor unit and supports the air outlet side of the water-receiving tray, to elevate the air outlet side of the water-receiving tray. The inclined water-receiving tray make the water easily discharged from a water outlet at the air outlet side, thus no serious water collection occurs and the phenomenon that wind blows the water is avoided.

REFERENCE NUMERALS

Figure 1:
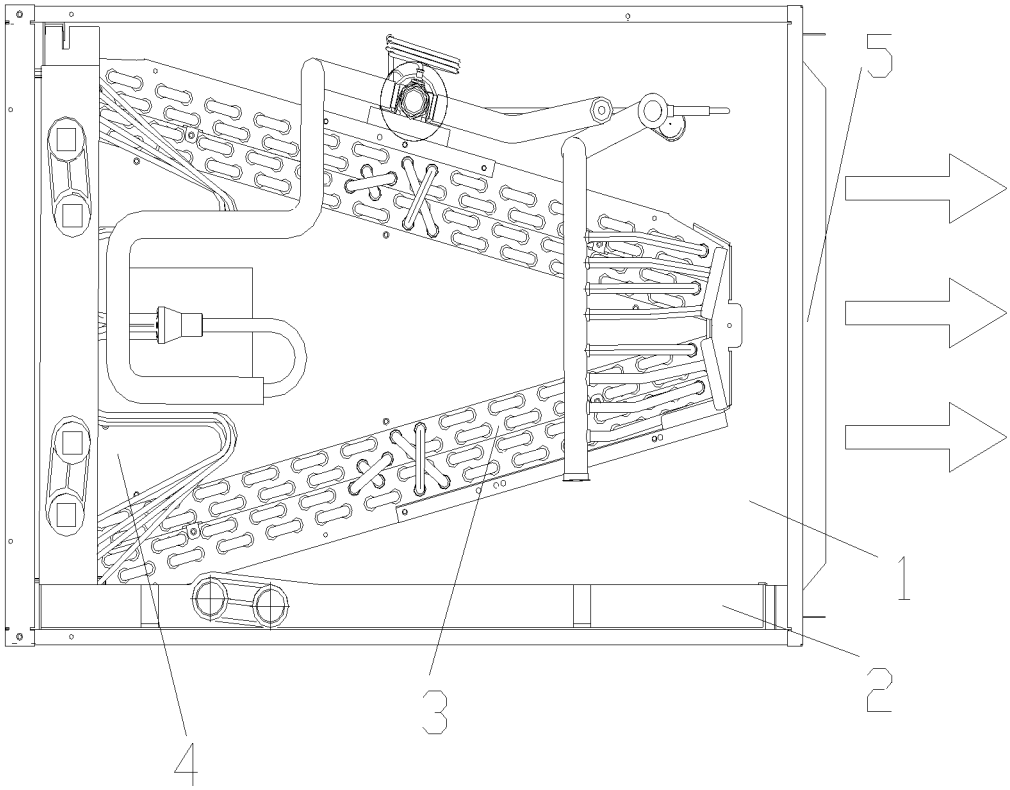
FIG. 1 is a schematic view of an indoor unit of an air conditioner in the prior art.

1 indoor unit;

2 water-receiving tray;

3 heat exchanger;
4 return-air inlet;
5 air outlet;
6 threaded hole;
7 bolt;
8 buckle plate;
9 fixed edge plate.

DETAILED DESCRIPTION

Embodiments of the present disclosure will be further described in detail in combination with the drawings and examples. The embodiments described herein are used to explain the present disclosure and shall not be construed to limit the present disclosure.

In the description of the present disclosure, it should be understood that, unless specified or limited otherwise, the terms "mounted," "connected," and "coupled" and variations thereof are used broadly, for example they may be fixed connections, also can be detachable connections or integrally connections; they can be mechanical or electrical mountings, connections and couplings, also can be direct and indirect mountings, connections, and couplings by intermediation, and further can be inner communication between two components. The terms "above" "below" "higher" "lower" all are position limitations made for purposes of description, and the position limitations are based arrangement directions shown in the drawings and have no direct relations to the arrangement directions in fact. Terms such as "first" and "second" are used herein for purposes of distinction, so as to facilitate the descriptions and don't represent any substantial differences there between. To those skilled in the art, a specific meaning of the above terms in the present disclosure may be understood according to actual situations.

Products and methods are described in detail by means of basic designs, extension designs and alternative designs in the following.

Figure 2:
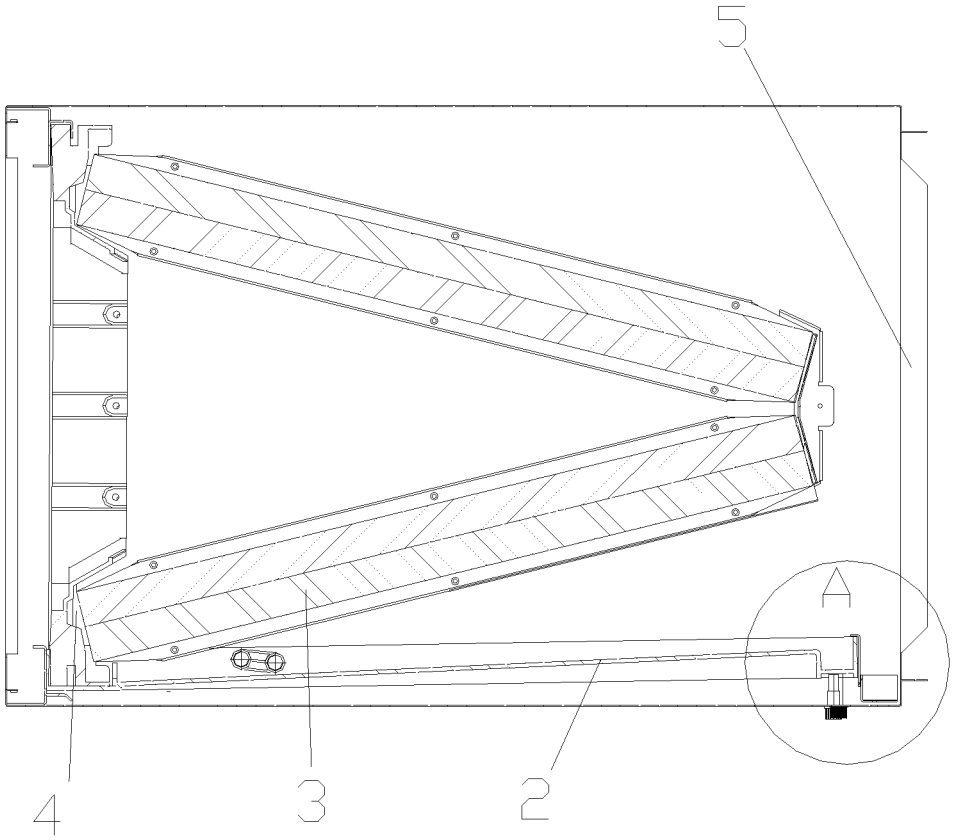
FIG. 2 is a schematic view of a water-receiving tray structure for an indoor unit of an air conditioner in an embodiment of the present disclosure.
Figure 3:
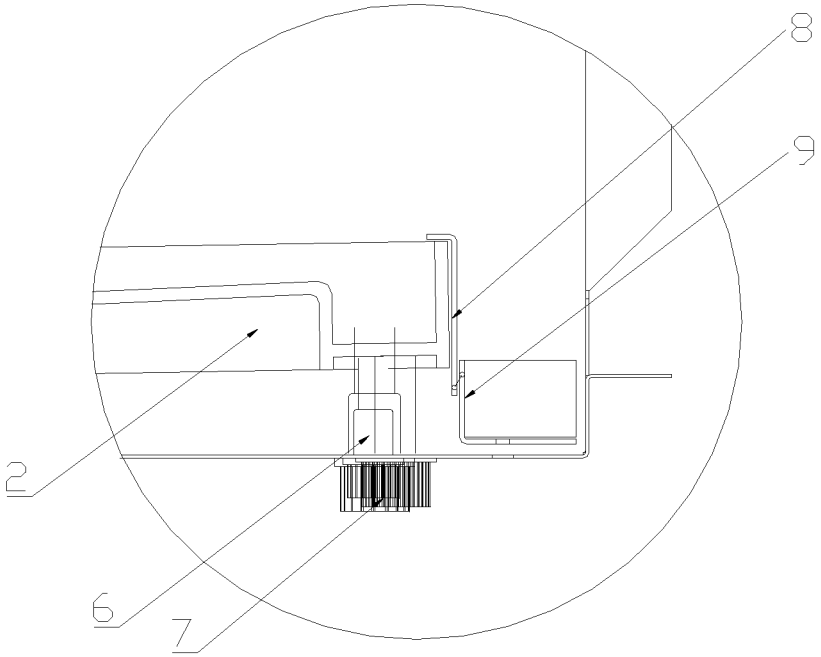
FIG. 3 is an enlarged view of the area A in FIG. 2.

FIG. 2 and FIG. 3 illustrate a water-receiving tray structure for an indoor unit of an air conditioner, the water-receiving tray structure includes: a water-receiving tray 2, an elevating member and a fixed member. The water-receiving tray 2 described herein specifically refers to the water-receiving tray 2 for receiving water in the case of transverse arrangement, that is, the water-receiving tray 2 is arranged in a direction from a return-air inlet 4 to an air outlet 5 and is located below a heat exchanger 3 of an indoor unit 1. Certainly, in some indoor units, there may also be a water-receiving tray for longitudinal arrangement, which may not influence the protection scope of the present disclosure. After exchanging heat, the indoor unit 1 blows the air of which the heat is exchanged out. Thus, a casing of the indoor unit 1 has a first end defining the return-air inlet 4, and a second end opposite to the first end and defining the air outlet 5. Air is blown from a direction of the return-air inlet 4 to a direction of the air outlet 5. The elevating member is arranged at an air outlet end of the indoor unit 1 and may support an air outlet side of the water-receiving tray 2, to make the water-receiving tray 2 inclined, so that the water in the water-receiving tray 2 may flow to a water outlet rapidly. As the water-receiving tray 2 tends to be unstable after being inclined, with respect to this case, the fixed member is also arranged in the indoor unit 1 and is connected to the air outlet side of the indoor unit 1.

Based on the elevating scheme provided in the above, persons skilled in the art may adopt various kinds of embodiments. An elevating member is provided herein, which includes a threaded hole 6 and a bolt 7. The air outlet end of the casing of the indoor unit 1 defines the threaded hole, and the threaded hole is located below the air outlet side of the water-receiving tray 2. The bolt 7 passes through the threaded hole and can extend to a bottom of the air outlet side of the water-receiving tray.

The position of the threaded hole is defined herein, the blot 7 passing through the threaded hole 6 may support the bottom of the water-receiving tray 2, so as to elevate the air outlet side of the water-receiving tray. Certainly, in other embodiments, the threaded hole 6 and the bolt 7 may also be replaced with a through hole and a pin. The air outlet side of the water-receiving tray may also be elevated by a rope.

Based on the above designs, the fixed member is generally configured as a spring, and exerts a tensile force or a thrust by an elastic force of the spring. A first end of the spring is connected to the air outlet side of the water-receiving tray 2 and a second end of the spring is connected to an inner wall of the casing of the indoor unit 1.

The connections of the first end and the second end of the spring are not specified herein, and the first end and the second end of the spring may be connected to corresponding area as long as the spring can exert an acting force. Certainly, arranging the position of the connection between the spring and the inner wall of the casing of the indoor unit 1 as close as possible to the air outlet side of the water-receiving tray is recommended.

If the spring is configured as a tension spring, the first end of the spring is higher than the second end of the spring. When the water-receiving tray 2 is elevated, distance between the water-receiving tray 2 and a bracket on the adjacent side wall of the indoor unit 1 is increased, and the spring is elongated, so as to exert a counter-acting force and pull the water-receiving tray 2 back.

If the spring is configured as a pressure spring, the first end of the spring is lower than the second end of the spring. When the water-receiving tray 2 is elevated, distance between the water-receiving tray 2 and the bracket on the adjacent side wall of the indoor unit 1 is increased, and the spring is shortened, so as to exert the counter-acting force and push the water-receiving tray 2 back. In this case the outgoing air run through the pressure spring and the pressure spring may produce resistance to the air. Accordingly, the tension spring may be more preferable than the pressure spring relatively.

In addition, to increase stability of the water-receiving tray 2, the fixed member may further include a buckle plate 8. The buckle plate 8 is in the shape of an inverted L, an upper portion of the buckle plate 8 is fixedly hooked to the air outlet side of the water-receiving tray 2 and a lower portion of the buckle plate 8 is fixedly connected to the first end of the spring. A contact area between the buckle plate 8 and the water-receiving tray 2 is larger than an area of the connection point between the spring and the water-receiving tray 2 if the spring is directly connected to the water-receiving tray 2, thus better fixing the water-receiving tray 2. When the water-receiving tray 2 is elevated, the water-receiving tray 2 and the buckle plate 8 move synchronously.

In a long-time operation of the indoor unit 1, the water-receiving tray 2 may shake if the wind is heavy. To further improve the stability effect, a fixed edge plate 9 is arranged to an inner side wall of the indoor unit 1. A side wall of the fixed edge plate 9 defines a guide-track groove, and a lower portion of the buckle plate 8 is placed in the guide-track groove. The buckle plate 8 is configured to move in the guide-track groove and the guide-track groove serves to guide the moving direction. Moreover, a moving route of position of the buckle plate 8 and the water-receiving tray 2 is fixed, so as to avoid lateral waggling when the buckle plate 8 and the water-receiving tray 2 are moving. In some embodiments, as for the spring, the second end of the spring may be directly fixed to the fixed edge plate 9.

To provide a more comprehensive protection for the present disclosure, an indoor unit of an air conditioner is further provided, and is provided with a heat exchanger and a water-receiving tray structure for the indoor unit therein. In which, a casing of the indoor unit has a first end defining a return-air inlet and a second end opposite to the first end and defining an air outlet. A water-receiving tray of the water-receiving tray structure is arranged in a direction from the return-air inlet to the air outlet and is located below the heat exchanger.

To provide a more comprehensive protection for the present disclosure, an air conditioner is provided and includes an indoor unit.

The above embodiments are simply some embodiments of the present disclosure and cannot be construed to limit the present disclosure, and changes, alternatives, and modifications can be made in the embodiments without departing from spirit, principles and scope of the present disclosure.

What is claimed is:

1. A water-receiving tray structure for an indoor unit of an air conditioner, comprising:

a water-receiving tray, an elevating member and a fixed member; and, wherein the indoor unit having a casing with a first end defining a return-air inlet and a second end opposite to the first end and defining an air outlet, the water-receiving tray being arranged in a direction from the return-air inlet to the air outlet and being located below a heat exchanger of the indoor unit; and, wherein the elevating member being arranged at the air outlet end of the indoor unit and supporting an air outlet side of the water-receiving tray such that the air outlet side of the water-receiver tray is higher than the return-air inlet side of the water-receiving tray; and the fixed member being arranged in the indoor unit and being connected to the air outlet side of the indoor unit, wherein the fixed member further comprises a buckle plate, the buckle plate is in the shape of an inverted L, an upper portion of the buckle plate is fixedly hooked to the air outlet side of the water-receiving tray and a lower end of the buckle plate is in contact with a fixed edge plate.

2. The water-receiving tray structure according to claim 1, wherein the elevating member comprises a threaded hole and a bolt;

the threaded hole is arranged at an air outlet end of the casing of the indoor unit and is located below the air outlet side of the water-receiving tray; and the bolt passing through the threaded hole extends to a bottom of the air outlet side of the water-receiving tray.

3. The water-receiving tray structure according to claim 1, wherein the fixed edge plate is arranged to an inner side wall of the indoor unit, a side wall of the fixed edge plate defines a guide-track groove, and a lower portion of the buckle plate is placed in the guide-track groove.

* * * * *